US008171976B2

(12) United States Patent
Hikasa et al.

(10) Patent No.: US 8,171,976 B2
(45) Date of Patent: May 8, 2012

(54) TRANSFERRING DEVICE

(75) Inventors: Mitsuhiro Hikasa, Osaka (JP); Kinya Matsushita, Osaka (JP)

(73) Assignee: Kokuyo S&T Co., Ltd., Osaka-shi (JP)

( * ) Notice: Subject to any disclaimer, the term of this patent is extended or adjusted under 35 U.S.C. 154(b) by 44 days.

(21) Appl. No.: 12/827,779

(22) Filed: Jun. 30, 2010

(65) Prior Publication Data

US 2010/0263799 A1 Oct. 21, 2010

Related U.S. Application Data

(63) Continuation of application No. 11/595,855, filed on Nov. 13, 2006.

(30) Foreign Application Priority Data

Nov. 15, 2005 (JP) ..... 2005-330875

(51) Int. Cl.
*B32B 37/26* (2006.01)
*B26F 3/02* (2006.01)
*B43L 19/00* (2006.01)

(52) U.S. Cl. ..... 156/577; 156/574; 156/579; 118/207

(58) Field of Classification Search ..... 156/574, 156/577, 579; 118/207
See application file for complete search history.

(56) References Cited

U.S. PATENT DOCUMENTS 5,405,471 A 4/1995 LeMaster
6,508,287 B1 1/2003 Shinozaki et al.

FOREIGN PATENT DOCUMENTS

DE 41 04 331 A1 8/1992
JP 2002-178694 A 6/2002
JP 2005-319619 A 11/2005

OTHER PUBLICATIONS

European Search Report dated Mar. 26, 2007, issued in corresponding European Application No. EP 06 12 2843.

*Primary Examiner* — Mark A Osele
(74) *Attorney, Agent, or Firm* — Westerman, Hattori, Daniels & Adrian, LLP

(57) ABSTRACT

In a transferring device (A) structured such that a paste (Tb) is transferred to a paper strip (P) by being slid in a predetermined transferring direction in a state in which the paper strip (P) is pinched between a transferring device main body (1) and a transferred object receiving cradle (2), the transferring device is provided with a guide surface (12*a*) guiding the paper strip (P) in the same direction as a transferring direction by being brought into contact with an edge portion (Pa), and a deflection upper roller (11) energizing the paper strip (P) toward the guide surface (12*a*) at a time of the sliding movement by being arranged so as to be deflected at a predetermined angle toward the guide surface (12*a*) from the transferring direction.

8 Claims, 8 Drawing Sheets

TRANSFERRING DEVICE

CROSS-REFERENCE TO RELATED APPLICATIONS

This application is a continuation of U.S. application Ser. No. 11/595,855, filed on Nov. 13, 2006 which is based upon and claims the benefit of priority from the prior Japanese Patent Application No. 2005-330875, filed on Nov. 15, 2005, the entire contents of which are incorporated herein by reference.

BACKGROUND OF THE INVENTION

1. Field of the Invention

The present invention relates to a transferring device used for transferring a transfer object to a transferred object such as a paper or the like.

2. Description of the Related Art

There have been conventionally considered various transferring devices used at a time of transferring a transfer object such as a solid or a liquid paste, tapes including an adhesive tape, a tape having no adhesive property and the like, an adhesive agent or the like to a transferred object such as the papers. The transferring device for transferring the transfer object mentioned above is generally provided with a case holding the transfer object in an inner portion, and a transfer head for delivering the transfer object held within the case to the transferred object. The transfer head is structured such as to be brought into contact with the transferred object so as to transfer the transfer object to the transferred object. The transferring device mentioned above is structured such as to transfer the transfer object to a transferred object surface by sliding the transfer head on the transferred object in a state in which a holder is held in hand and is in contact with the transferred object surface by a user (refer, for example, to Japanese Unexamined Patent Publication No. 2002-178694 (FIG. 2 and the like)).

Further, there has been developed a transferring device transferring the transfer object by additionally providing a transferred object receiving cradle at a position facing to a transferring device main body transferring the transfer object and sliding the transferred object in a predetermined transferring direction in a state in which the transferred object is pinched between the transferring device main body and the transferred object receiving cradle, for the purpose of simply transferring wherever without selecting the place and without necessity of using any cradle such as a table, a desk or the like for placing the transferred object at a time of transferring, in comparison with the conventional structure mentioned above (refer, for example, to Japanese Patent Application No. 2004-137807, FIG. 8 and the like).

In the case of the transferring device mentioned above, an edge portion of the transferred object is pinched by the transferring device with respect to the transferred object held by one hand by gripping the transferring device by the other hand, and the transferring device is slid along the edge portion of the transferred object on the basis of a motion using a bending of a wrist from the state mentioned above. The publication mentioned above points out a problem at a time of executing the bending motion of the wrist in this operation. In other words, the publication points out a fact that the transferring device draws an approximately circular locus on the basis of a rotational motion by the bending of the wrist and it is hard to accurately transfer the transfer object along the edge portion of the transferred object. In the case mentioned above, there is considered that a skill for accurately moving the transferring device is required for a user using the transferring device.

In order to solve the point mentioned above, the publication also discloses a technique in which a guide portion for bringing into contact with the edge portion of the transferred object is provided so as to be deflected at a slight angle from the transferring direction, thereby correcting a displacement in the transferring direction caused by the rotation of the bending of the wrist.

SUMMARY OF THE INVENTION

However, in the case that the guide portion is provided so as to be deflected from the transferring direction as mentioned above, an actual transferring direction is different from a guiding direction by the guide portion. Accordingly, for example, in the case that the transferring device is slid while being conscious of the bending motion of the wrist, in the case that the transferring device is slid accurately in the transferring direction, or the like, there is a possibility that the transfer object is transferred in the other directions by the guide portion on the contrary. If so, there can be considered to be generated a possibility that an additional work for familiarizing the transferring device is required for the user, and an uncomfortable feeling about a use feeling of the transferring device is applied to the user even if the user familiarizes the transferring device.

The present invention is made by paying attention to the problem mentioned above, and provides a transferring device by which the user can easily and accurately transfer in a desired transferring direction without any uncomfortable feeling.

In order to achieve the object mentioned above, the present invention employs the following means. In other words, a transferring device in accordance with the present invention comprises: a transferring device main body having a transferring portion transferring a transfer object to a transferred object including a paper; a transferred object receiving cradle additionally provided in the transferring device main body; and the transferring device being structured such that the transfer object is transferred to the transferred object by being slid in a predetermined transferring direction in a state in which the transferred object is pinched between the transferring device main body and the transferred object receiving cradle, wherein the transferring device comprises: a guide surface capable of guiding the transferred object in the same direction as the transferring direction at a time of the sliding movement by being brought into contact with an edge portion of the transferred object; and a deflection roller capable of energizing the transferred object toward the guide surface at a time of the sliding movement by being arranged so as to be deflected at a predetermined angle toward the guide surface from the transferring direction.

In accordance with the structure mentioned above, since the transferring device and the transferred object are moved away from each other in accordance with a snap or the like using the bending of the wrist at an operating time of sliding the transferring device, it is possible to effectively solve the problem that the transfer object is transferred while being deflected from the accurate direction. Further, the user can transfer the transferred object in the accurate direction without any uncomfortable feeling, by the guide surface provided in the same direction as the transferring direction.

In order to smoothly energize the transferred object to the guide surface side, it is desirable to be structured such that the deflection rollers are provided at respective facing positions to the transferring device main body side and the transferred object receiving cradle side, and the deflection rollers are brought into contact with the same position in the transferred object from two faces.

In order to obtain a structure in which the transfer object can be accurately transferred to the transferred object from the start of the transfer, it is desirable that the deflection roller is arranged in a transfer base end side in the transferring direction rather than the transferring portion.

Further, as a preferable angle for preferably energizing the transferred object toward the guide surface by the deflection roller, it is desirable that a predetermined angle deflecting the deflection roller is set to 1 degree to 10 degrees.

Further, as far as the transferring device is provided with the rotational moving mechanism relatively moving between the pinching enablement position capable of pinching the transferred object by rotationally moving the transferred object receiving cradle with respect to the transferring device main body in the predetermined direction and the transferring portion exposing position at which a leading end portion of the transferring portion is exposed, the structure is not limited to the aspect that the transfer object is transferred along the edge portion of the transferred object, but it is possible to properly use an aspect that the transfer object can be transferred at a desired position, that is, the same aspect as the conventional transferring device.

In accordance with the present invention, it is possible to effectively solve the problem that the transfer object is transferred while being deflected from the accurate direction due to the bending motion of the wrist or the like. Further, since it is possible to transfer the transferred object in the accurate direction by the guide surface provided in the same direction as the transferring direction, without any particular conscious of the user and without any uncomfortable feeling, it is possible to provide the transferring device which can be comfortably used by the user.

DESCRIPTION OF THE PREFERRED EMBODIMENTS

A description will be given below of an embodiment in accordance with the present invention with reference to the accompanying drawings.

Figure 1:
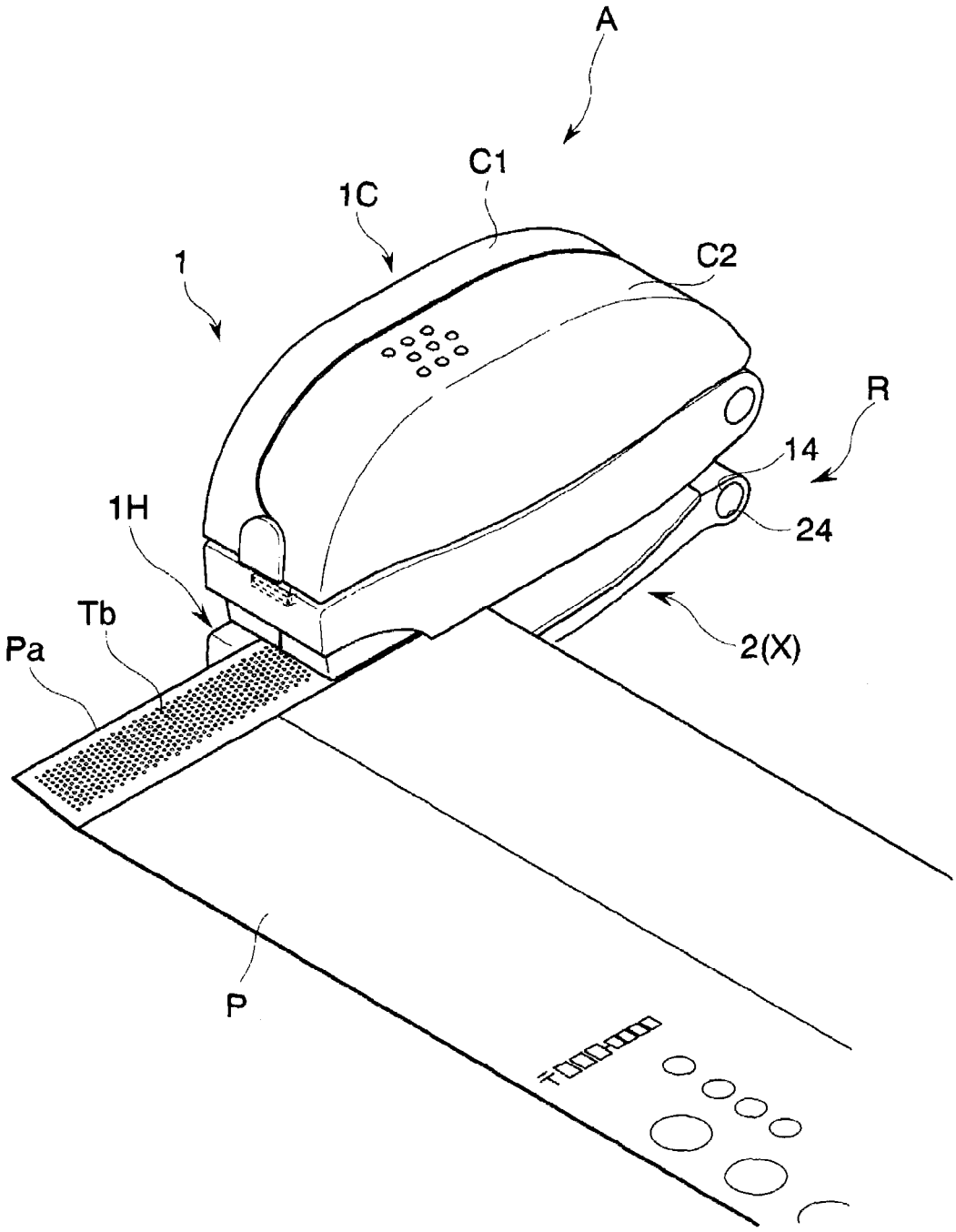
FIG. 1 is an outline view showing a transferring device in accordance with an embodiment of the present invention.
Figure 2:
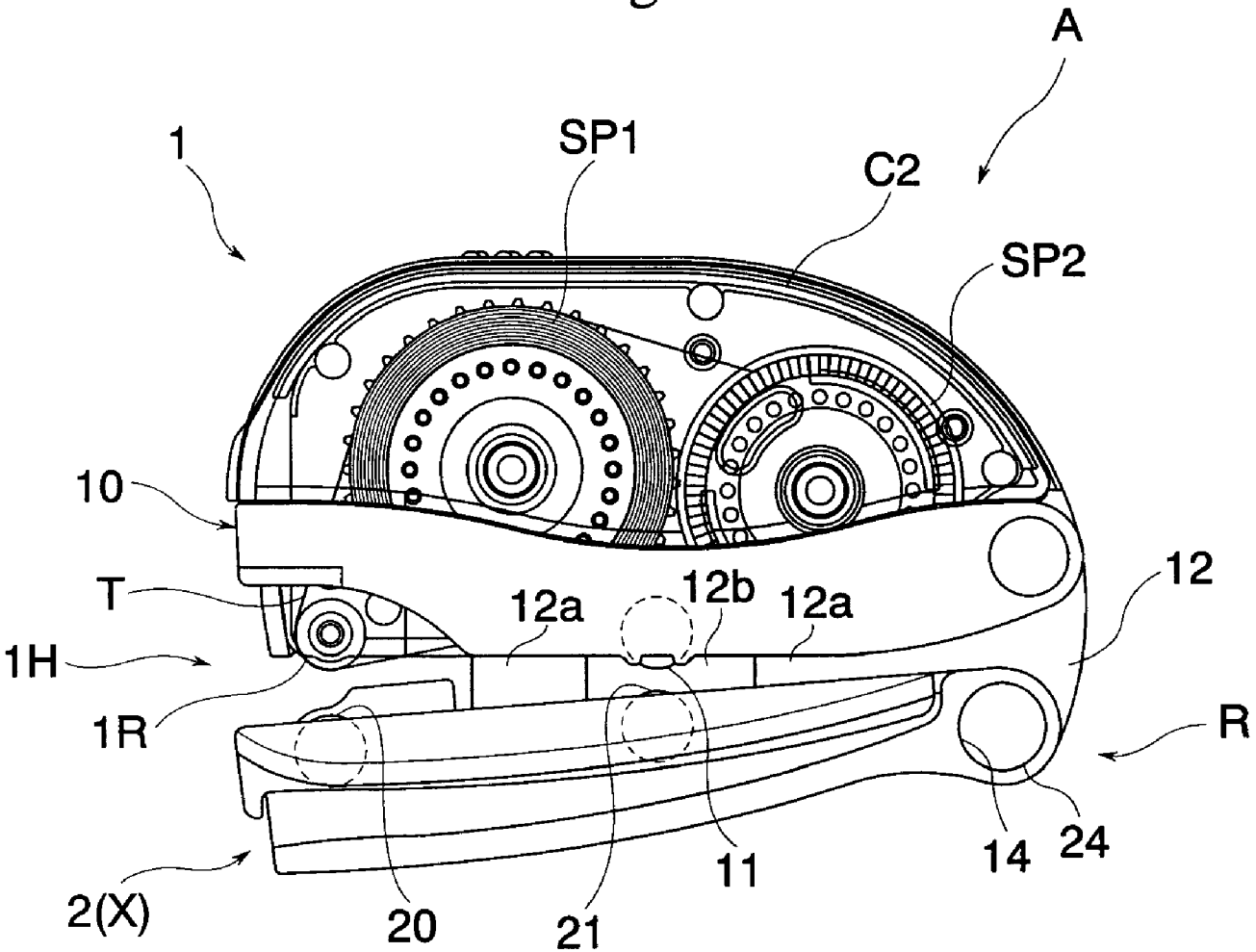
FIG. 2 is a front elevational view showing the transferring device in accordance with the embodiment.
Figure 3:
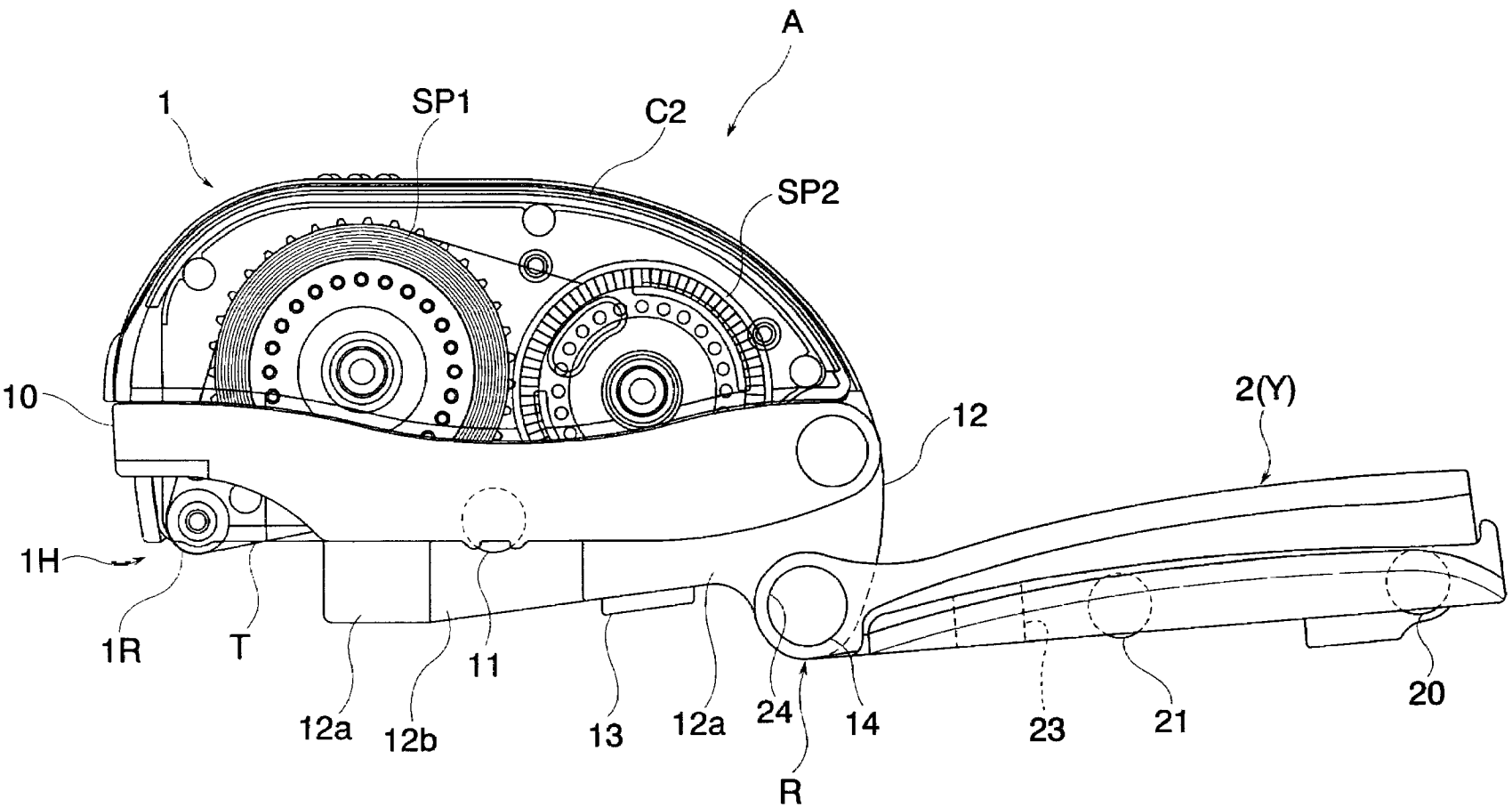
FIG. 3 is a front elevational view showing the other aspect of the transferring device in accordance with the embodiment.

A transferring device A is mainly constituted by a transferring device main body 1 structured such as to accommodate a tape T with paste and a delivering mechanism part delivering the tape T with paste, and a transferred object receiving cradle 2 for inserting a paper strip P with respect to the transferring device main body 1 at a time of transferring a paste Tb, as shown in FIGS. 1, 2 and 3.

In this case, the transferring device A in accordance with the present embodiment is provided with a guide surface 12*a* capable of guiding the paper strip P in the same direction as a transferring direction at a time of sliding by being brought into contact with an edge portion Pa of the paper strip P corresponding to the transferred object, and a deflection upper roller 11 and a deflection lower roller 21 corresponding to a deflection roller capable of energizing the paper strip P toward the guide surface 12*a* at a time of sliding by being arranged so as to be deflected at a predetermined angle toward the guide surface 12*a* from the transferring direction.

A description will be in detail given below of a particular structure of the transferring device A with reference to FIGS. 1, 2, 3, 4 and 5.

The transferring device main body 1 is mainly constituted by a case 1C and a frame body 10, as shown in FIG. 1 and the like.

The case 1C is mainly constituted by a case main body C1 approximately forming a half-split structure and a refilling cartridge C2.

The case main body C1 is structured such that only the refilling cartridge C2 can be replaced in a state in which the case main body C1 is not generally separated from the frame body 10 and the transferred object receiving cradle 2, and holds a non-switched part corresponding to a part of the delivering mechanism part for supplying the tape T with paste to the paper strip P.

The refilling cartridge C2 is structured such that a transfer head 1H corresponding to a transferring portion is attached to a front end portion thereof. Further, the structure is made such as to set the tape T with paste corresponding to an expendable part, a winding off spool SP1 and a take-up spool SP2 corresponding to a portion of the delivering mechanism part for supplying the tape T with paste to the paper strip P, and the transfer head 1H and the like as the replaceable parts, and replace them by new ones in a state in which they are additionally provided in the refilling cartridge C2.

As shown in FIGS. 2 and 3, the transfer head 1H is mainly constituted by the tape T with paste wound off from the winding off spool SP1 and a transfer roller 1R supporting the tape T with paste in a state of exposing the tape T with paste to an outer side of the transferring device main body 1. Further, the transfer roller 1R is rotated in the same direction so as to deliver the tape T with paste, at a time of sliding the transferring device A itself in the transferring direction of transferring the paste Tb in a state in which the transfer head 1H is brought into contact with the paper strip P.

As shown in FIGS. 2 and 3, the frame body 10 is provided with both of a function of holding the case 1C so as to make the transferring device A in a usable state, and a function of making the case 1C in a state in which the case 1C can be disassembled into the case main body C1 and the refilling cartridge C2. In particular, the frame body 10 is mainly constituted by a synthetic resin integrally molded product formed in an approximately frame shape in which a part of the frame body is continuously open to upper and lower sides and the transfer head 1H mentioned above is exposed to a lower side. Further, the frame body 10 is provided with a deflection upper roller 11, a downward wall 12, an upper elastic pawl 13 and a rotation shaft 14, and rotatably supports the transferred object receiving cradle 2 between a pinching enablement position (X) and an exposing position (Y) corresponding to a transferring portion exposing position via a rotational moving mechanism R in a lower side.

Figure 4:
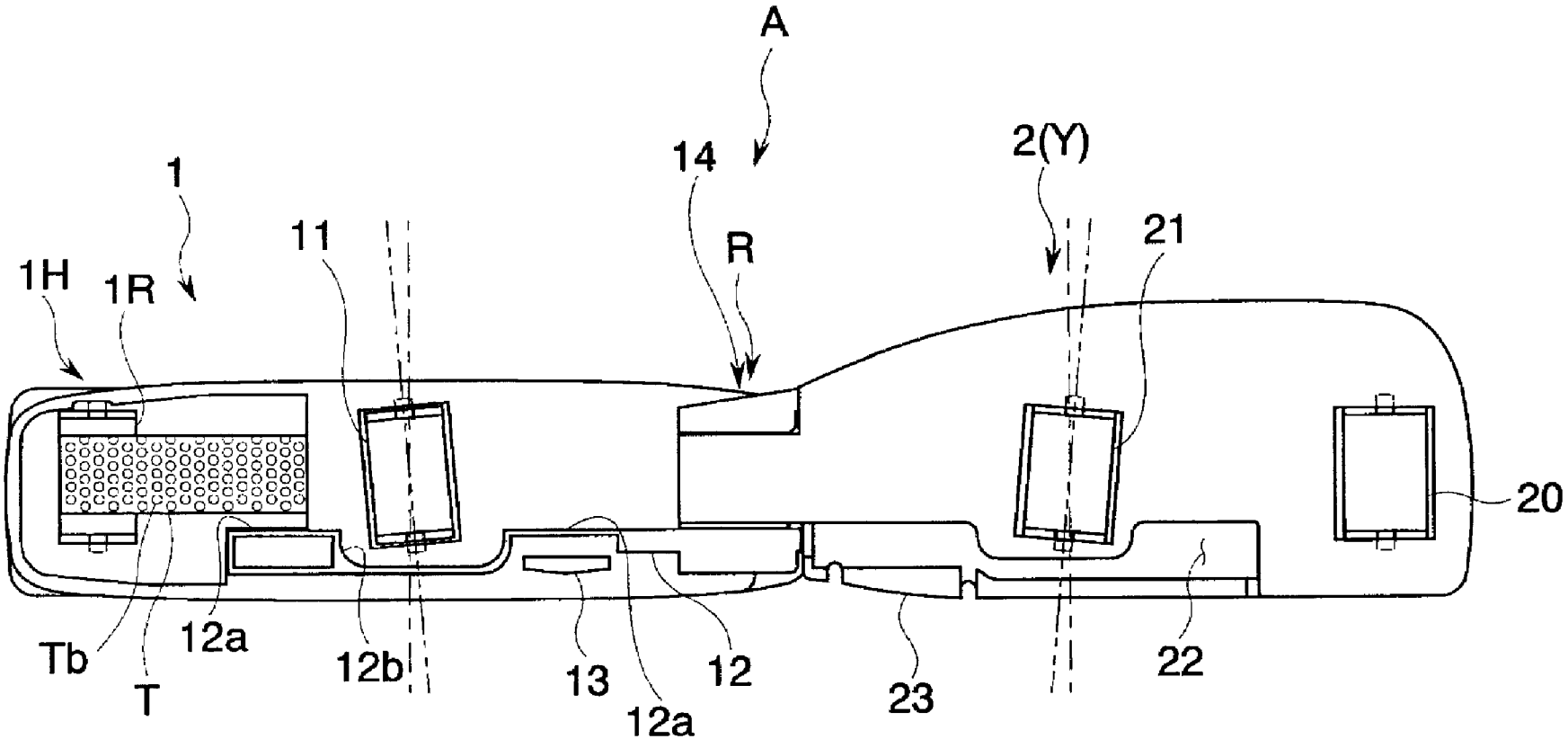
FIG. 4 is a bottom elevational view corresponding to FIG. 3.

As shown in FIGS. 2, 3 and 4, the deflection upper roller 11 is attached to an approximately center portion in a front view of the transferring device main body 1 in such a manner that a part including the lowest portion is exposed to an outer portion of the frame body 10. Particularly, in the present embodiment, as shown by using an imaginary line in FIG. 4, the deflection upper roller 11 is attached by deflecting a mounting angle of the deflection upper roller 11 to the frame body 10, for example, at 5 degrees with respect to a mounting direction of the transfer roller 1R and a drawing direction of a guide surface 12*a* mentioned below. In this case, this mounting angle is not limited to 5 degrees shown in the present embodiment, but can be set in a range between 1 degree and 10 degrees, whereby it is possible to sufficiently achieve the effect in accordance with the present invention. Further, the transferring device A in accordance with the present embodiment is structured such as to slide the paper strip P from a side in which the rotational moving mechanism R is arranged to a side in which the transfer head 1H is arranged, at a time of transferring. In other words, the deflection upper roller 11 is arranged close to the transfer base end side with respect to the transfer head 1H. In this case, in accordance with the present embodiment, the deflection upper roller 11 is positioned at a gap space pinched between an outer periphery of the winding off spool SP1 and an outer periphery of the take-up spool SP2 in the inner portion of the transferring device main body 1 by being arranged in the approximately center portion in the front view, thereby achieving an effective use of the space within the inner portion of the transferring device main body 1 so as to achieve a compact structure of the transferring device main body 1.

The downward wall 12 is formed so as to protrude downward from a slightly rear side of the transfer head 1H over a rear end portion of the frame body 10, as shown in FIGS. 3 and 4. Further, a rotation shaft 14 rotatably supporting the transferred object receiving cradle 2 is protruded from a rear end portion of the downward wall 12. Further, an inner surface side of the downward wall 12 forms a flat guide surface 12*a* provided so as to be drawn in the same direction as the transferring direction, and a concave surface 12*b* provided in such a manner as to be prevented from being interfered with the deflection upper roller 11 and the mounting position thereof, and avoiding the interference with the deflection lower roller 21 in a state in which the transferred object receiving cradle 2 is set to the pinching enablement position.

The upper elastic pawl 13 is protruded to the lower side from the frame body 10 in the same manner as the downward wall 12, as shown in FIGS. 2, 3 and 4, and is provided for maintaining the transferred object receiving cradle 2 at the pinching enablement position (X) by being mutually engaged with a lower elastic pawl 23 mentioned below. In more detail, it is structures such that the upper elastic pawl 13 and the lower elastic pawl 23 are engaged with each other at a position where a distance between the transfer roller 1R and an auxiliary roller 20 mentioned below is spaced at a small dimension with respect to the lower elastic pawl 23, whereby at the pinching enablement position (X), the tape T with paste supported to the transfer roller 1R and the auxiliary roller 20 can rotate only between a position where the paper strip P is pinched from two sides and the position where the tape T with paste and the auxiliary roller 20 mentioned below are spaced at the small dimension. Further, the engagement between both the elastic pawls 13 and 23 is cancelled by relatively moving from the state in which the upper elastic pawl 13 and the lower elastic pawl 23 are engaged with each other to the direction in which the transferred object receiving cradle 2 is spaced, whereby the transferred object receiving cradle 2 comes to a state in which the exposing position (Y) shown in FIGS. 3 and 4 can be achieved.

The rotation shaft 14 is structured such as to protrude from a portion near the rear end portion and the lowest portion of the downward wall 12 and be rotatably engaged with a bearing 24 mentioned below, thereby being capable of constituting a rotational moving mechanism R. Further, an elastic member (not shown) is incorporated at an engaged position between the rotation shaft 14 and the bearing 24, and applies an elastic energizing force for avoiding an undesired contact between the transfer roller 1R and the auxiliary roller 20 at the pinching enablement position (X).

As shown in FIGS. 1, 2, 3 and 4, the transferred object receiving cradle 2 is rotatably attached to the transferring device main body 1 via the rotational moving mechanism R as mentioned above, and mainly has the auxiliary roller 20, the deflection lower roller 21, the wall accommodating portion 22, the lower elastic pawl 23 and the bearing 24.

The auxiliary roller 20 is attached at a position opposite to the transfer roller 1R in such a manner that a part including an upper end portion is exposed from the transferred object receiving cradle 2, as shown in FIGS. 2, 3 and 4, and is structured such as to smoothly execute the relative movement between the paper strip P and the transfer head 1H by being brought into contact with the paper strip P together with the transfer roller 1R.

The deflection lower roller 21 is arranged at a position facing to the deflection upper roller 11 in the present embodiment, as shown in FIGS. 2, 3 and 4. In other words, as shown by using an imaginary line in FIG. 4, it is attached by deflecting the mounting angle with respect to the transferred object receiving cradle 2, for example, at 5 degrees with respect to the mounting direction of the transfer roller 1R and the extending direction of the guide surface 12*a* mentioned below, and is attached so as to form a mirror positional relation with the deflection upper roller 11 on the boundary of the rotation shaft 14. Further, it is possible to effectively energize to the paper strip P mentioned below by constituting the state of being brought into contact with the paper strip P from two sides together with the deflection upper roller 11 under the state of pinching the paper strip P.

The wall accommodating portion 22 is a space for accommodating the lower end portion of the drawing piece in the inner portion at a time of setting the transferred object receiving cradle 2 to the pinching enablement position (X), as shown in FIG. 4. Accordingly, it is possible to achieve the smooth relative motion between the transferring device main body 1 and the transferred object receiving cradle 2.

As shown in FIGS. 3 and 4, the lower elastic pawl 23 can preferably maintain the transferred object receiving cradle 2 at the pinching enablement position (X) by being approximately engaged with the upper elastic pawl 13, as mentioned above.

The bearing 24 preferably structures the rotational moving mechanism R by preferably rotating the transferred object receiving cradle 2 between the pinching enablement position (X) and the exposing position as mentioned above on the basis of the engagement with the rotation shaft 14, as shown in FIGS. 2 and 3.

Accordingly, the transferring device A in accordance with the present embodiment is structured such as to energize the paper strip P toward the guide surface 12*a* at a time of sliding the paper strip P in the transferring direction in a state of pinching the paper strip P, on the basis of the provision of the deflection upper roller 11 and the deflection lower roller 21 mentioned above, and the guide surface 12*a*, whereby the edge portion Pa of the paper strip P can be accurately brought into contact with the guide surface 12*a* so as to be guided.

A description will be in detail given below of a series of operations of transferring the paste Tb along the edge portion Pa of the paper strip P while making the transferring device A pinch and slide the paper strip P, with reference to FIGS. 5, 6, 7 and 8.

Figure 5:
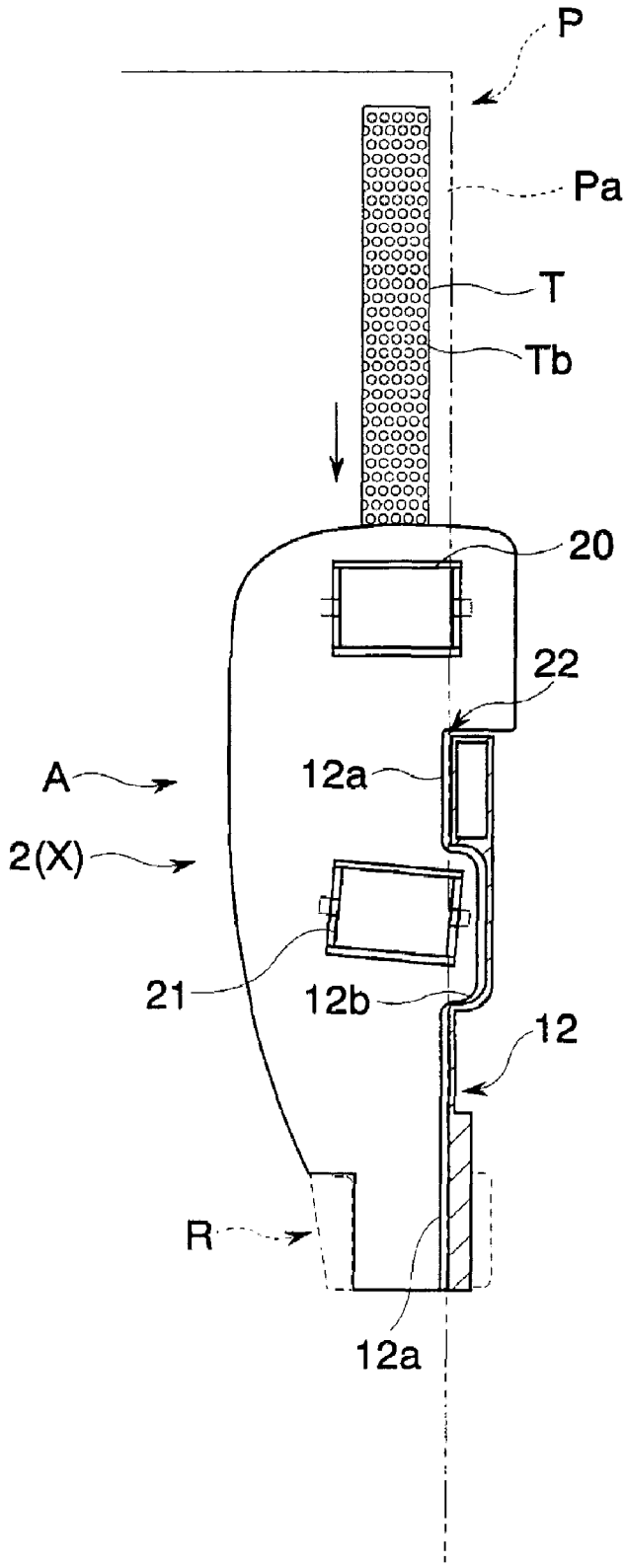
FIG. 5 is a schematic cross sectional view in accordance with the embodiment.

First, as shown in FIG. 5, in a process of transferring the paste Tb to the paper strip P, the deflection upper roller 11 and the deflection lower roller 21 are attached so as to be deflected at 5 degrees as mentioned above. In other words, when the deflection upper roller 11 and the deflection lower roller 21 are rotated while being brought into contact with the paper strip P, the paper strip P is delivered at an angle deflected to the guide surface 12*a* at 5 degrees with respect to the transferring direction.

Figure 6:
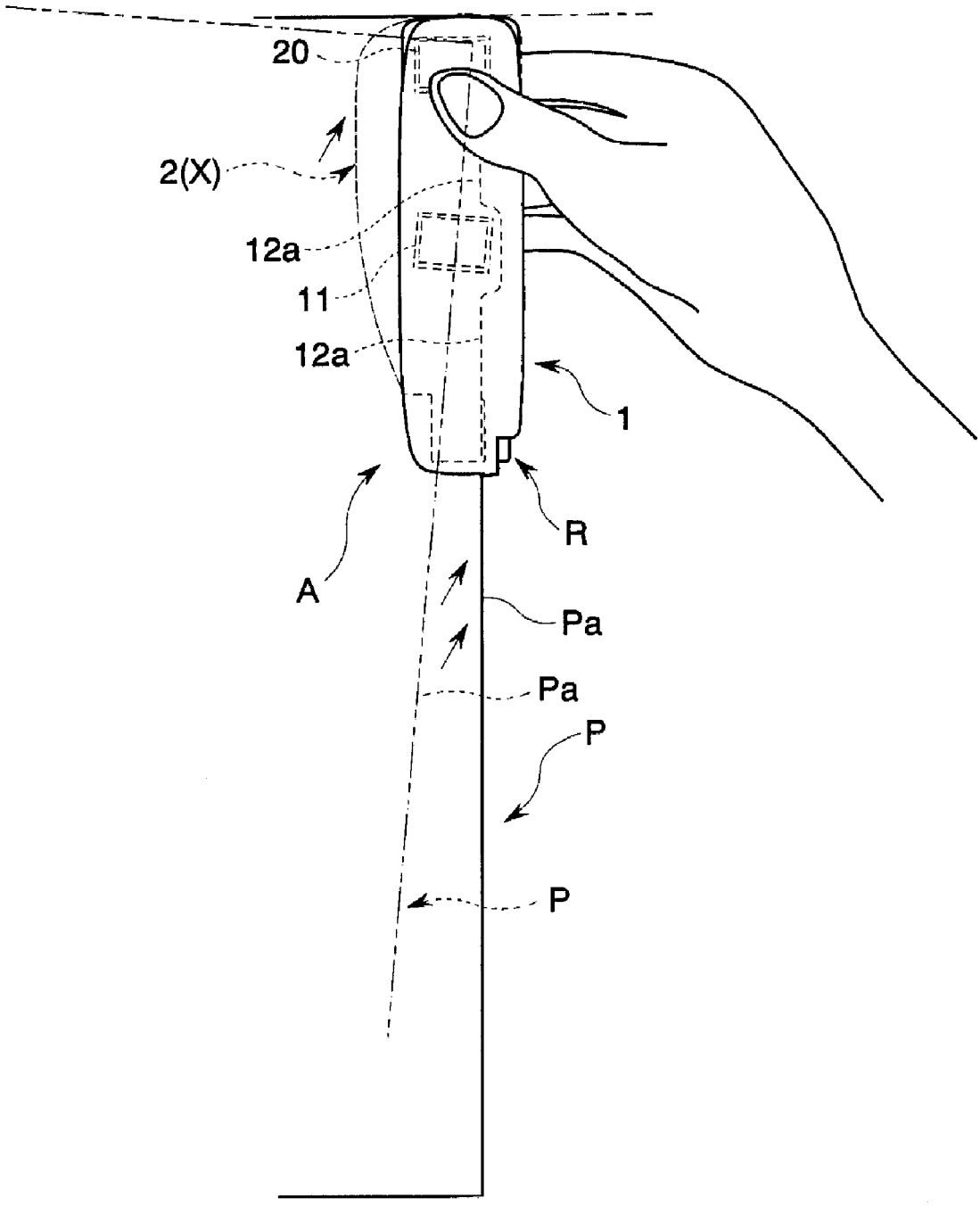
FIG. 6 is an explanatory view of an operation in accordance with the embodiment.
Figure 7:
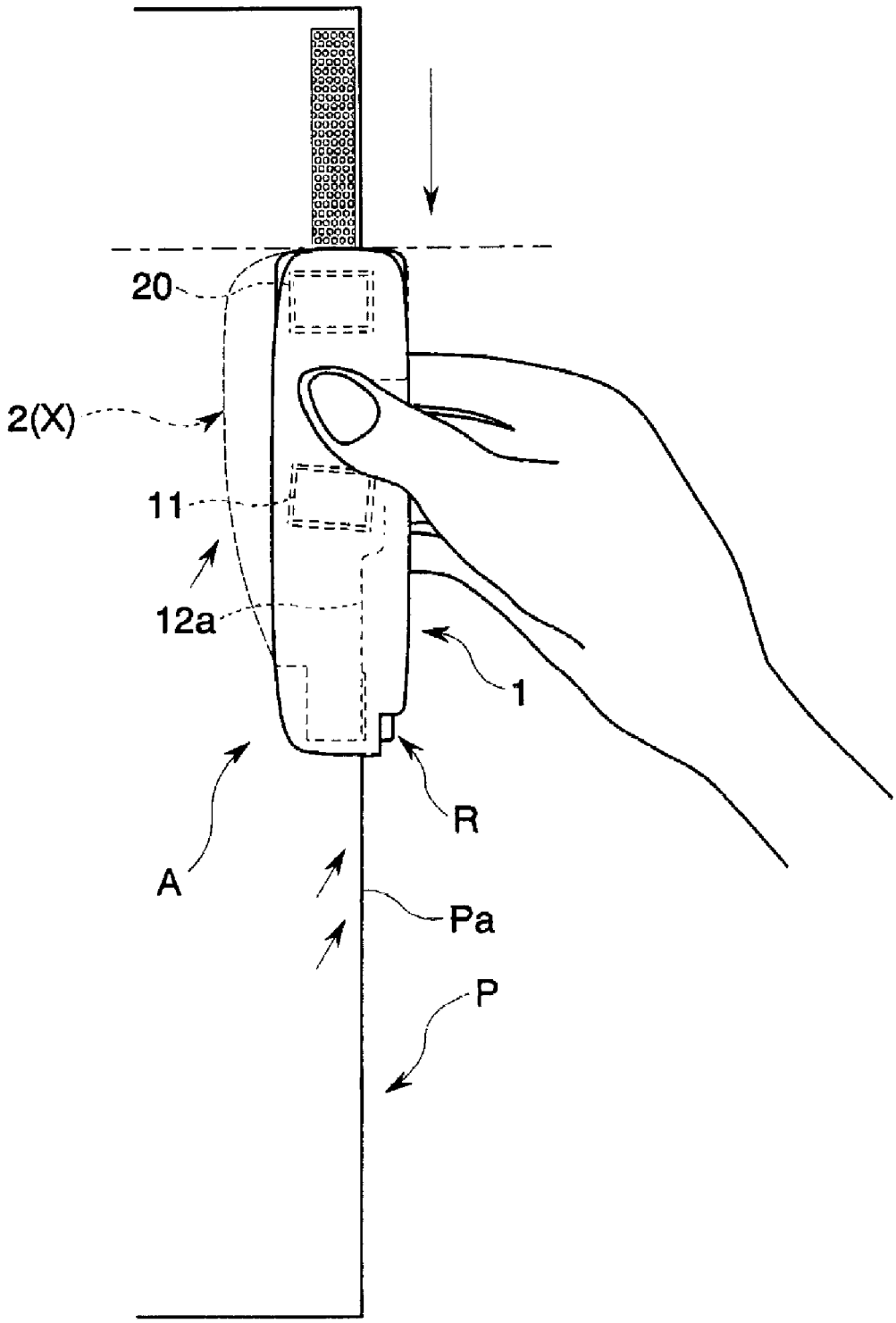
FIG. 7 is an explanatory view of an operation in accordance with the embodiment.
Figure 8:
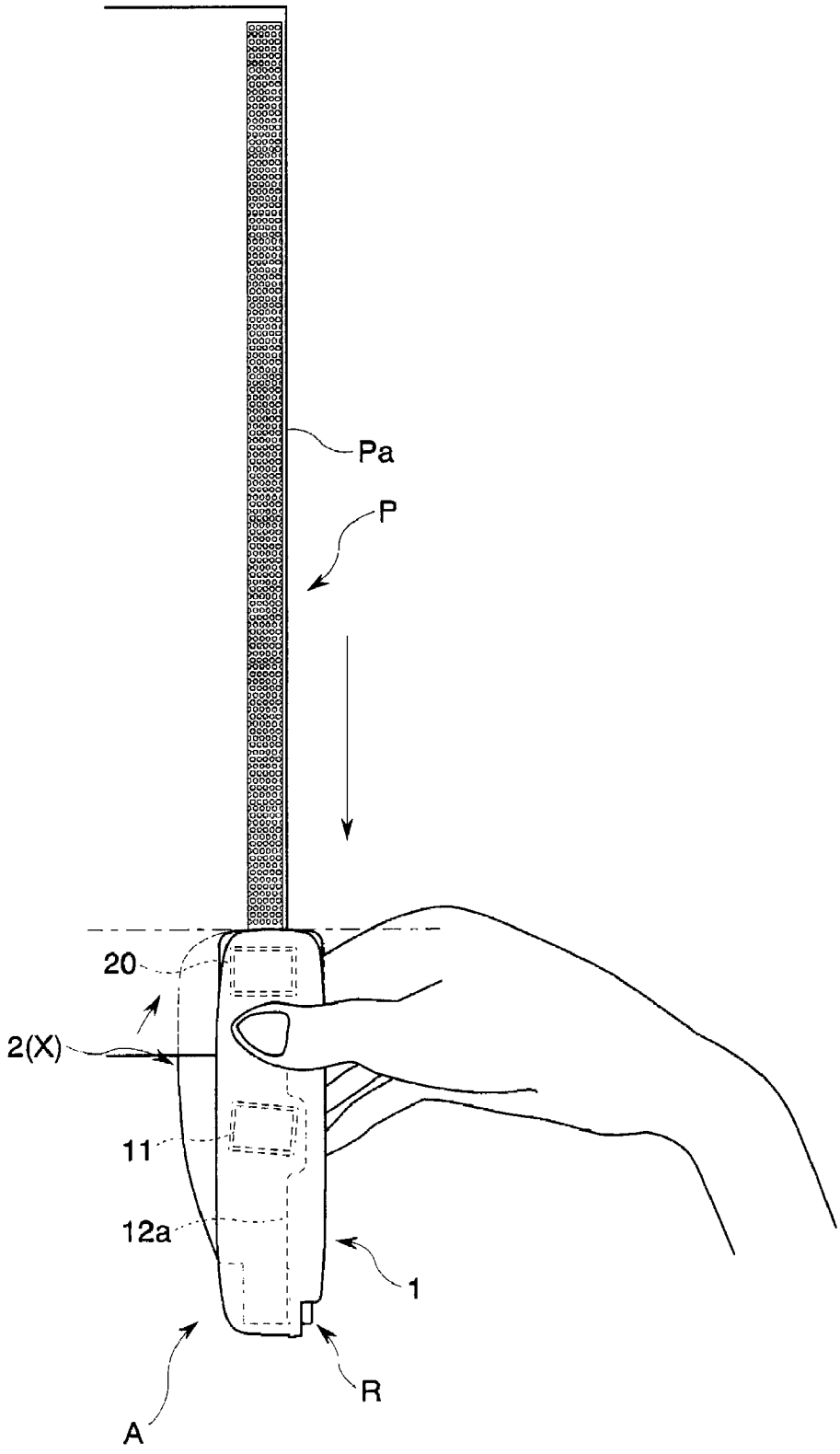
FIG. 8 is an explanatory view of an operation in accordance with the embodiment.

Further, as shown in FIGS. 6, 7 and 8, at a time of a series of operations when the user grips the transferring device A by the hand, and slides the transferring device A in the transferring direction mainly on the basis of the bending motion of the wrist, the deflection upper roller 11 and the deflection lower roller 21 deliver the paper strip P in the direction deflected at 5 degrees from the transferring direction, whereby the end portion Pa of the paper strip P is moved in the direction of being brought into contact with the guide surface 12*a* or the state of being brought into contact with the guide surface 12*a* is maintained. In this case, the direction in which the paper strip P is energized is schematically shown by an arrow in the drawing. Further, as shown in FIGS. 7 and 8, even in the case that a force in an undesired direction is applied in the direction in which the end portion Pa and the guide surface 12*a* are moved away from each other, on the basis of the snap motion using the bending of the wrist or the like, the energizing force by the deflection upper roller 11 and the deflection lower roller 21 cancels the force in the undesired direction, whereby the paper strip P is slid accurately while being corrected in the direction in which the guide surface 12*a* is extended, that is, the transferring direction. Particularly as shown in FIG. 6, even in the case that the end portion Pa of the paper strip P is arranged so as to be deflected at a slight angle from the transferring direction in a state in which the paste has not transferred yet, such as the paper strip P shown by an imaginary line in the drawing, at a time of starting the transfer (or immediately before the transfer), the deflection upper roller 11 and the deflection lower roller 21 are positioned in the transfer base end side rather than the transfer roller 1R. Accordingly, the direction of the end portion Pa of the paper strip P is corrected by the deflection upper roller 11 and the deflection lower roller 21, and the paste Tb is correctly transferred in the transferring direction from the transfer starting time. Of course, even in the case that the position of the paper strip P is erroneously shifted in the process of the transfer as shown in FIG. 7, the direction of the end portion Pa of the paper strip P is corrected by the deflection upper roller 11 and the deflection lower roller 21 while transferring the paste Tb.

Further, since the transferring device A structures the rotational moving mechanism R rotatably connecting the transferring device main body 1 and the transferred object receiving cradle 2, by the rotation shaft 14 and the bearing 24, for example, in the case that it is intended to transfer the paste Tb to a desired position of the paper strip P mounted on the desk or the like or in the case that the transferring device is used in the same manner as the existing transferring device, it is preferable to rotationally move the transferred object receiving cradle 2 to the lower side so as to achieve the exposing position (Y) shown in FIG. 3 in which the transfer head 1H is exposed.

As mentioned above, since the transferring device A in accordance with the present embodiment is provided with the guide surface 12*a* which can guide in the same direction as the transferring direction, and the deflection upper roller 11 and the deflection lower roller 21 corresponding to the deflection roller arranged at 5 degrees corresponding to the predetermined angle toward the guide surface 12*a* from the transferring direction, it is possible to effectively cancel the displacement of the paste Tb corresponding to the transfer object caused by the deflection between the transferring device A and the paper strip P in accordance with the snap or the like (FIGS. 6, 7 and 8) using the bending of the wrist at a time of sliding the paper strip P, and it is possible to accurately guide the paper strip P to the guide surface 12*a* provided in the same direction as the transferring direction. In accordance with the structure mentioned above, the user can slide the transferring device A on the basis of a natural operation without being sensitive about the snap using the bending of the wrist, a rotation of an elbow or the like, thereby accurately transferring the paste Tb corresponding to the transfer object along the edge portion Pa of the paper strip P. Further, even in the case that the user slides the transferring device A while being conscious of the transferring direction, the guide surface 12*a* and the rotating direction of the transfer roller 1R, that is, the transferring direction are set to the same direction. Accordingly, it is possible to effectively avoid the matter that the paste Tb is transferred so as to be deflected in accordance that the paste Tb eats into the inner side from the edge portion Pa of the paper strip P.

Further, since the deflection upper roller 11 and the deflection lower roller 21 are provided at the respective facing positions in the transferring device main body 1 side and the transferred object receiving cradle 2 side, the structure is made such that the paper strip P is delivered while pinching the same position in the paper strip P from two sides, whereby the paper strip P can be smoothly energized to the guide surface 12*a* side. Further, since the deflection upper roller 11 and the deflection lower roller 21 are arranged in the transfer base end side which can be brought into contact with the paper strip P prior to the transfer head 1H corresponding to the transferring portion, the paper strip P can be brought into contact with the transfer head 1H in the state in which the paper strip P is previously energized in the deflected direction so as to be positioned to the guide surface 12*a*, thereby being in the accurate position and direction from the starting stage of the transfer. Further, since the angle at which the deflection upper roller 11 and the deflection lower roller 21 corresponding to the deflection roller are deflected is set to 5 degrees in the present embodiment, that is, within the range between 1 degree and 10 degrees mentioned above, it is possible to effectively avoid the matter that the sufficient energizing force can not be obtained due to the too small angle while effectively avoiding an appearance of wrinkle or the like caused by the unnatural energization of the paper strip P due to the too large angle. In other words, it is possible to preferably transfer the paste Tb by converting the operating force on the basis of the sliding motion into the proper energizing force.

The description is given above of the embodiment in accordance with the present invention, however, the particular structures of the respective portions are not limited to only the embodiment mentioned above, but can be variously modified within the range of the scope of the present invention.

For example, the deflection upper roller is provided in the frame body in the embodiment mentioned above, however, it may be constituted by a replacement part additionally provided in the cartridge. Further, the angle at which the deflection roller is deflected is not limited to the angle mentioned above, but can be set to various angles in accordance with the magnitude, the shape or the like of the roller. Further, the deflection rollers are not respectively limited to the single rollers, but may be constituted by a structure in which a plurality of rollers are provided so as to face to each other, or a structure in which a caterpillar-shaped crawler belt is provided in outer peripheries of a plurality of rollers so as to form an endless track.

In addition, the particular structures of the respective portions are not limited to the embodiment mentioned above, but can be variously modified within the range of the scope of the present invention.

What is claimed is:

1. A transferring device comprising:

a transferring device main body having a transferring portion transferring a transfer object to a transferred object including a paper; and a transferred object receiving cradle additionally provided in the transferring device main body; and the transferring device being structured such that the transfer object is transferred to the transferred object by being slid in a predetermined transferring direction in a state in which the transferred object is pinched between the transferring device main body and the transferred object receiving cradle, wherein the transferring device comprises:

a guide surface capable of guiding the transferred object in the same direction as the transferring direction at a time of the sliding movement by being brought into contact with an edge portion of the transferred object;

deflection rollers capable of energizing the transferred object toward the guide surface at a time of the sliding movement by being arranged so as to be deflected at a predetermined angle toward the guide surface from the transferring direction;

a rotational moving mechanism for relatively moving between a pinching enablement position, and an exposing position, said pinching enablement position is configured so as to pinch the transferred object by rotationally moving the transferred object receiving cradle with respect to the transferring device main body in the predetermined direction, said exposing position is configured so that a leading end portion of the transferring portion is exposed; and a concave surface for preventing interference among said deflection rollers in said pinching enablement position, wherein the transferring portion is positioned at a front end portion of the transferring device and the rotational moving mechanism is positioned at a rear end portion of the transferring device.

2. The transferring device as set forth in claim 1, including:

a concave surface for preventing interference with a deflection upper roller and a mounting position for said deflection upper roller.

3. The transferring device as set forth in claim 1, wherein:

said rotational moving mechanism having a bearing for moving between the pinching enablement position and the exposing position.

4. A transferring device comprising:

a transferring device main body having a transferring portion transferring a transfer object to a transferred object including a paper; and a transferred object receiving cradle additionally provided in the transferring device main body; and the transferring device being structured such that the transfer object is transferred to the transferred object by being slid in a predetermined transferring direction in a state in which the transferred object is pinched between the transferring device main body and the transferred object receiving cradle, wherein the transferring device comprises:

a guide surface capable of guiding the transferred object in the same direction as the transferring direction at a time of the sliding movement by being brought into contact with an edge portion of the transferred object;

deflection rollers capable of energizing the transferred object toward the guide surface at a time of the sliding movement by being arranged so as to be deflected at a predetermined angle toward the guide surface from the transferring direction;

a rotational moving mechanism for relatively moving between a pinching enablement position, and a exposing position, said pinching enablement position is configured so as to pinch the transferred object by rotationally moving the transferred object receiving cradle with respect to the transferring device main body in the predetermined direction, said exposing position is configured so that a leading end portion of the transferring portion is exposed; and an upper elastic pawl and a lower elastic pawl to engage with each other so as to maintain the transferring device main body and the transferred object receiving cradle at said pinching enablement position, wherein the transferring portion is positioned at a front end portion of the transferring device and the rotational moving mechanism is positioned at a rear end portion of the transferring device.

5. The transferring device as set forth in claim 4, including:

a concave surface for preventing interference among said deflection rollers in said pinching enablement position.

6. The transferring device as set forth in claim 4, wherein:

said upper elastic pawl protrudes downwardly from a frame body of the transferring device main body.

7. The transferring device as set forth in claim 4, including:

a concave surface for preventing interference with a deflection upper roller and a mounting position for said deflection upper roller.

8. The transferring device as set forth in claim 4, wherein:

said rotational moving mechanism having a bearing for moving between the pinching enablement position and the exposing position.

* * * * *